US012137727B2

(12) United States Patent
Park et al.

(10) Patent No.: US 12,137,727 B2
(45) Date of Patent: Nov. 12, 2024

(54) AEROSOL GENERATING ARTICLE AND AEROSOL GENERATING DEVICE COMPRISING SAME

(71) Applicant: KT&G CORPORATION, Daejeon (KR)

(72) Inventors: In Su Park, Seoul (KR); Dong Kyun Ko, Sejong (KR); Sang Won Choi, Daejeon (KR); Sun Hwan Jung, Daejeon (KR); Eun Mi Jeoung, Daejeon (KR)

(73) Assignee: KT&G CORPORATION, Daejeon (KR)

( * ) Notice: Subject to any disclaimer, the term of this patent is extended or adjusted under 35 U.S.C. 154(b) by 762 days.

(21) Appl. No.: 17/254,361

(22) PCT Filed: Oct. 29, 2019

(86) PCT No.: PCT/KR2019/014395

§ 371 (c)(1),
(2) Date: Dec. 21, 2020

(87) PCT Pub. No.: WO2020/091394

PCT Pub. Date: May 7, 2020

(65) Prior Publication Data

US 2021/0267266 A1 Sep. 2, 2021

(30) Foreign Application Priority Data

Oct. 30, 2018 (KR) ..... 10-2018-0131322

(51) Int. Cl.
*A24D 1/20* (2020.01)
*A24B 15/167* (2020.01)
(Continued)

(52) U.S. Cl.
CPC ..... *A24D 1/20* (2020.01); *A24B 15/167* (2016.11); *A24D 3/17* (2020.01); *A24F 40/10* (2020.01);
(Continued)

(58) Field of Classification Search
CPC ..... A24F 40/10; A24F 40/42; A24F 40/20
See application file for complete search history.

(56) References Cited

U.S. PATENT DOCUMENTS 5,469,871 A 11/1995 Barnes et al.
6,761,174 B2 7/2004 Jupe et al.
(Continued)

FOREIGN PATENT DOCUMENTS

CA 2 487 706 A1 5/2006
CN 1503637 A 6/2004
(Continued)

OTHER PUBLICATIONS

Notice of Reasons for Refusal dated Jul. 19, 2022 from the Japanese Patent Office in Japanese Application No. 2020-569966.
(Continued)

*Primary Examiner* — Truc T Nguyen
(74) *Attorney, Agent, or Firm* — Sughrue Mion, PLLC

(57) ABSTRACT

The present invention provides an aerosol-generating article including a first aerosol-generating substrate portion, a second aerosol-generating substrate portion, and a filter portion containing nicotine, and an aerosol-generating device comprising the same, wherein the second aerosol-generating substrate portion includes an absorber impregnated with a liquid aerosol-generating composition.

8 Claims, 5 Drawing Sheets

(51) Int. Cl.

| | |
|---|---|
| ***A24D 3/17*** | (2020.01) |
| ***A24F 40/10*** | (2020.01) |
| ***A24F 40/20*** | (2020.01) |
| ***A24F 40/30*** | (2020.01) |
| ***A24F 40/46*** | (2020.01) |

(52) U.S. Cl.
CPC ..... *A24F 40/20* (2020.01); *A24F 40/30* (2020.01); *A24F 40/46* (2020.01)

(56) References Cited

U.S. PATENT DOCUMENTS

| | | | | |
|---|---|---|---|---|
| 7,647,932 | B2 | 1/2010 | Cantrell et al. | |
| 7,699,061 | B2 | 4/2010 | Seitert et al. | |
| 8,864,909 | B2 | 10/2014 | Mishra et al. | |
| 9,277,770 | B2 | 3/2016 | DePiano et al. | |
| 9,456,633 | B2 | 10/2016 | Liu | |
| 9,826,777 | B2 | 11/2017 | Seo et al. | |
| 11,140,916 | B2 | 10/2021 | Zuber et al. | |
| 11,246,998 | B2 | 2/2022 | Greim et al. | |
| 11,882,858 | B2 * | 1/2024 | Kim | A61Q 19/02 |
| 2008/0092912 | A1 | 4/2008 | Robinson et al. | |
| 2012/0042885 | A1 | 2/2012 | Stone et al. | |
| 2014/0123991 | A1 | 5/2014 | Fujita et al. | |
| 2015/0101606 | A1 * | 4/2015 | White | A61M 15/00 131/194 |
| 2015/0150302 | A1 | 6/2015 | Metrangolo et al. | |
| 2015/0209530 | A1 | 7/2015 | White | |
| 2016/0250201 | A1 | 9/2016 | Rose et al. | |
| 2016/0295926 | A1 | 10/2016 | Zuber | |
| 2016/0338402 | A1 | 11/2016 | Buehler et al. | |
| 2017/0049153 | A1 * | 2/2017 | Guo | H05B 3/18 |
| 2017/0055576 | A1 * | 3/2017 | Beeson | A24F 42/10 |
| 2017/0086508 | A1 | 3/2017 | Mironov et al. | |
| 2018/0007974 | A1 * | 1/2018 | Thorens | A61M 15/003 |
| 2018/0015237 | A1 | 1/2018 | Thorens | |
| 2018/0132534 | A1 | 5/2018 | Reevell | |
| 2018/0169355 | A1 | 6/2018 | Reevell | |
| 2018/0235283 | A1 | 8/2018 | Zuber et al. | |
| 2019/0281891 | A1 * | 9/2019 | Hejazi | A24D 1/045 |
| 2020/0015520 | A1 | 1/2020 | Lavanchy et al. | |
| 2020/0128880 | A1 * | 4/2020 | Gage | A24F 42/60 |
| 2020/0323268 | A1 | 10/2020 | Thorens et al. | |
| 2021/0267271 | A1 * | 9/2021 | Park | A24F 40/10 |
| 2022/0175015 | A1 * | 6/2022 | Jeong | A24D 1/20 |
| 2023/0010295 | A1 * | 1/2023 | Batista | H05B 6/362 |
| 2023/0240364 | A1 * | 8/2023 | Xie | A24F 40/42 131/329 |

FOREIGN PATENT DOCUMENTS

| | | | | |
|---|---|---|---|---|
| CN | 101557728 | A | 10/2009 | |
| CN | 104159458 | A | 11/2014 | |
| CN | 104203015 | A | 12/2014 | |
| EA | 200501604 | A1 | 8/2006 | |
| EP | 1 889 550 | A1 | 2/2008 | |
| EP | 3 039 972 | A1 | 7/2016 | |
| EP | 3 275 319 | A1 | 1/2018 | |
| GB | 2534211 | A | 7/2016 | |
| JP | 6-189733 | A | 7/1994 | |
| JP | 07-155161 | A | 6/1995 | |
| JP | 2008-35861 | A | 2/2008 | |
| JP | 2009-502194 | A | 1/2009 | |
| JP | 2013-524850 | A | 6/2013 | |
| JP | 5719931 | B2 | 5/2015 | |
| JP | 2015-517817 | A | 6/2015 | |
| JP | 2016-516402 | A | 6/2016 | |
| JP | 2018-511317 | A | 4/2018 | |
| KR | 10-2014-0135173 | A | 11/2014 | |
| KR | 10-1465846 | B1 | 11/2014 | |
| KR | 10-2016-0112769 | A | 9/2016 | |
| KR | 10-1684756 | B1 | 12/2016 | |
| KR | 10-1803983 | B1 | 12/2017 | |
| KR | 20220063860 | * | 5/2022 | A24F 1/20 |
| RU | 2 639106 | C1 | 12/2017 | |
| RU | 2 656 089 | C2 | 5/2018 | |
| RU | 2 667 883 | C2 | 9/2018 | |
| WO | 2007/015735 | A1 | 2/2007 | |
| WO | 2011/139730 | A1 | 11/2011 | |
| WO | 2013/120566 | A2 | 8/2013 | |
| WO | 2014/150979 | A2 | 9/2014 | |
| WO | 2015/015568 | A1 | 2/2015 | |
| WO | 2015/074187 | A1 | 5/2015 | |
| WO | 2015-117705 | A2 | 8/2015 | |
| WO | 2017/149093 | A1 | 9/2017 | |
| WO | 2017/182485 | A1 | 10/2017 | |
| WO | WO 2018/114313 | * | 6/2018 | A24F 47/00 |
| WO | WO 2021060768 | * | 4/2021 | A24F 40/57 |

OTHER PUBLICATIONS

Office Action dated Feb. 4, 2022, issued in Korean Application No. 10-2018-0131322.
Office Action dated Jan. 25, 2022, issued in Japanese Application No. 2020-569966.
International Search Report for PCT/KR2019/014395 dated Feb. 11, 2020 [PCT/ISA/210].
Extended European Search Report issued Nov. 8, 2021 in European Application No. 19879826.6.
Office Action issued Oct. 1, 2021 in Russian Application No. 2021102366.
Russian Office Action dated Sep. 15, 2023 in Application No. 2023110960.
Communication dated Apr. 14, 2023, issued in Chinese Application No. 201980039860.7.
Russian Office Action issued Sep. 5, 2024 in Russian Application No. 2024106293.

* cited by examiner

AEROSOL GENERATING ARTICLE AND AEROSOL GENERATING DEVICE COMPRISING SAME

CROSS REFERENCE TO RELATED APPLICATIONS

This application is a National Stage of International Application No. PCT/KR2019/014395 filed on Oct. 29, 2019, claiming priority based on Korean Patent Application No. 10-2018-0131322 filed Oct. 30, 2018.

TECHNICAL FIELD

This application claims priority from Korean Patent Application No. 10-2018-0131322 filed on Oct. 30, 2018, and all contents disclosed in the documents of the Korean patent application are incorporated herein by reference.

The present invention relates to an aerosol-generating article and an aerosol generating device including the same.

BACKGROUND ART

In general, tobacco refers to a perennial plant belonging to the Solanaceae of the dicotyledonous plant order, and recently, also collectively refers to a cigarette manufactured for the purpose of smoking in which the leaves of tobacco are wrapped with cigarette paper and a filter portion is formed at one side. There are thousands of kinds of cigarettes worldwide, and they have been released in various shapes and forms.

In the case of combustion-type cigarettes such as cigarettes, leaf cigarettes, and pipe cigarettes, many ingredients such as tar, nitroamines, hydrocarbons, and carbon monoxide are contained in the smoke, in addition to aerosols containing nicotine.

As an alternative to compensate for the disadvantages of such combustion-type cigarettes, a method of generating an aerosol by heating an aerosol-generating material in a cigarette instead of a method of generating an aerosol by burning the cigarette, has been widely used, and demand for this is increasing. Accordingly, research is actively being conducted on heating-type cigarettes or heating-type aerosol-generating devices.

In detail, an aerosol-generating device has a form similar to a conventional combustion-type cigarette, and generates mainstream smoke including aerosols by heating an aerosol-generating material in a heating-type cigarette through a means such as a heater or ultrasonic vibration. Therefore, an aerosol-generating device has the advantage of minimizing emission of ingredients such as tar while functioning to satisfy the smoking desire of smokers, thereby forming a new market that replaces conventional combustion-type cigarettes.

However, despite these advantages, when the generated mainstream smoke is not sufficiently vaporized and contains many liquid substances such as moisture, the aerosol-generating device may not provide a feeling of satisfaction to the smoker, and various techniques have been proposed to solve this problem.

Korean Patent Application Publication No. 2016-0112769 discloses that a vapor regeneration heater is provided near a gas extraction port to remove water or moisture contained in an aerosol, thereby simultaneously satisfying needs of smokers and non-smokers.

In addition, Korean Patent Application Publication No. 2014-0135173 discloses that smoking satisfaction can be improved by providing a sheet material including a plurality of channels extending in a longitudinal direction in a heating-type cigarette as a cooling member and condensing water vapor in the aerosol generated.

These patents have alleviated the problem of low quality of aerosols and unsatisfactory smoking feeling to some extent by changing the structure of an aerosol-generating device or a filter of a heating-type cigarette, but the effect of the improvement is not sufficient.

In addition, a conventional aerosol-generating article has a structure in which an aerosol is generated by heating a medium and a substance added to the medium, and in the aerosol-generating article, the aerosol generation amount is not constant when the medium is heated because it is difficult to conduct even heat transfer due to variations in the length, arrangement, and absorption of additives of a reconstituted tobacco sheet or cut tobacco in the medium. In particular, an amount of atomization generated by the additive glycerin must be maintained until the end of smoking, but conventional aerosol-generating articles that add glycerin to a medium have a problem that the amount of atomization is not maintained constant until the end of smoking.

Accordingly, there is an increasing need for an aerosol-generating article capable of maintaining a constant amount of atomization until smoking is ended.

REFERENCES

Patents (Patent reference 1) Korean Patent Application Publication No. 2016-0112769

(Patent reference 1) Korean Patent Application Publication No. 2014-0135173

DESCRIPTION OF EMBODIMENTS

Technical Problem

Accordingly, the present inventors conducted various studies to solve the above problem, and as a result, by introducing a separate second aerosol-generating substrate to the aerosol-generating article and heating the nicotine-containing first aerosol-generating substrate and the second aerosol-generating substrate at the same time, it has been confirmed that a certain amount of aerosol can be generated until smoking is ended. Through this, the present invention has been completed.

Accordingly, an object of the present invention is to provide an aerosol-generating article capable of generating a constant sufficient amount of aerosol from the start of smoking to the end of smoking.

It is also an object of the present invention to provide an aerosol-generating device including the aerosol-generating article.

Technical Solution to Problem

To achieve the object, the present invention may include a nicotine-containing first aerosol-generating substrate portion, a second aerosol-generating substrate portion, and a filter portion, wherein the second aerosol-generating substrate portion includes an absorber impregnated with a liquid aerosol-generating composition.

In one embodiment of the present invention, a weight ratio of glycerin contained in the nicotine-containing first aerosol-generating substrate portion and glycerin contained in the second aerosol-generating substrate portion may be 1 to 6:4 to 9.

In one embodiment of the present invention, the absorber impregnated with the liquid aerosol-generating composition may be directly included in a rolled form in an aerosol-generating article wrapper.

In one embodiment of the present invention, the nicotine-containing first aerosol-generating substrate portion may contain an aerosol-generating composition, and the aerosol-generating composition may contain a tobacco material, an additive in an amount of 0.2 to 50 parts by weight based on 100 parts by weight of the tobacco material, and glycerin in an amount of 0 to 400 parts by weight based on 100 parts by weight of the tobacco material.

In one embodiment of the present invention, the liquid aerosol-generating composition may contain glycerin in an amount from 5 parts by weight to 60 parts by weight, an additive in an amount from 5 parts by weight to 40 parts by weight, and water in an amount from 0 parts by weight to 10 parts by weight.

In one embodiment of the present invention, the second aerosol-generating substrate portion may be positioned in front of the nicotine-containing first aerosol-generating substrate portion, behind the nicotine-containing first aerosol-generating substrate portion, or at front and back of the nicotine-containing first aerosol-generating substrate portion.

In one embodiment of the present invention, the absorber is selected from a group consisting of paper, cotton, and silica.

In one embodiment of the present invention, the liquid absorber may be a rolled form of paper in which stripe-shaped wrinkles or sheaths are formed by crimping the paper.

In addition, the present invention provides an aerosol-generating device including an aerosol-generating article of present invention; and an aerosol-generating means which includes an aerosol-generating article receiving groove and a heater member provided under the aerosol-generating article receiving groove.

In one embodiment of the present invention, the heater member may be configured to simultaneously heat the nicotine-containing first aerosol-generating substrate portion and the second aerosol-generating substrate portion.

The aerosol-generating article according to the present invention can provide an effect of generating a constant sufficient amount of aerosol from the start of smoking to the end of smoking, by including a separate a second aerosol-generating substrate portion including an absorber impregnated with a liquid aerosol-generating composition and simultaneously heating a nicotine-containing first aerosol-generating substrate portion and the second aerosol-generating substrate portion when smoking.

In addition, according to the above-described effect, the aerosol-generating article of the present invention can improve satisfaction with smoking by providing an aerosol of excellent quality when smoking.

BEST MODE

Figure 1:
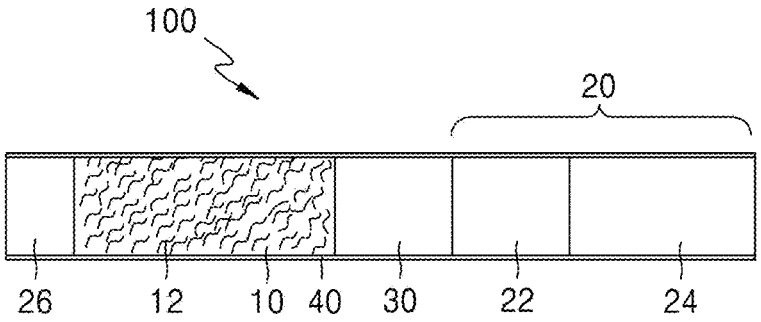
FIGS. 1 to 3 are diagrams showing embodiments of an aerosol-generating article of the present invention.
Figure 2:
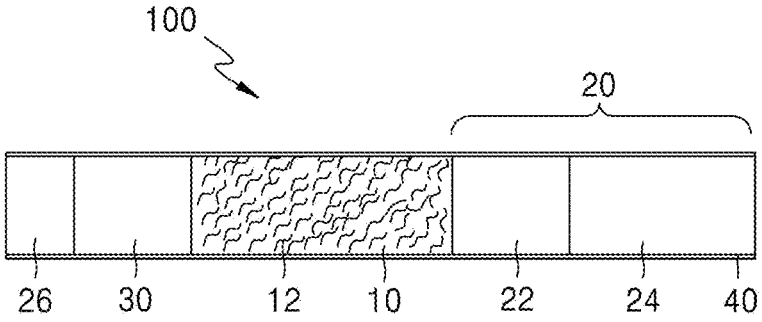
Figure 3:
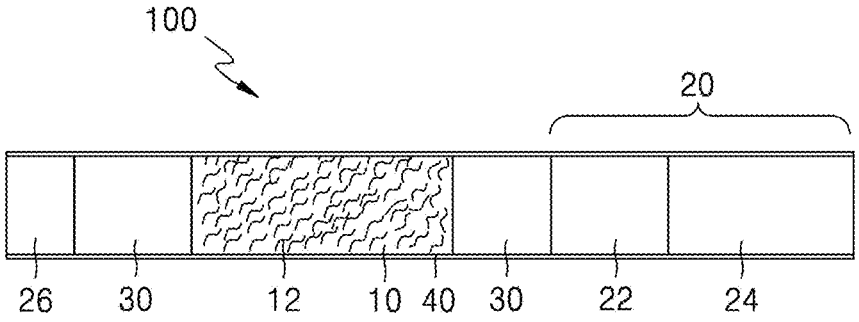

Hereinafter, the present invention will be described in more detail.

The terms or words used in the specification and claims should not be construed as being limited to their usual or dictionary meanings, and should be interpreted as meanings and concepts consistent with the technical idea of the present invention based on the principle that the inventor can properly define the concept of terms in order to explain his own invention in the best way.

The terms used in the present invention are only used to describe specific embodiments, and are not intended to limit the present invention. Singular expressions include plural expressions unless a context clearly indicates otherwise. In the present invention, terms such as "to include" or "to have" are intended to represent the existence of features, numbers, steps, actions, components, parts, or combinations thereof described in the specification, and is to be understood as not precluding the possibility of the presence or addition of one or more other features, numbers, steps, actions, components, parts, or combinations thereof.

The terms "in front of" and "behind" used in the present invention are defined based on the aerosol flow.

Hereinafter, embodiments of the present invention will be described in detail with reference to the accompanying drawings so that those of ordinary skill in the art may easily implement the present invention. However, the present invention may be implemented in various different forms and is not limited to the embodiments described herein.

Hereinafter, embodiments of the present invention will be described in detail with reference to the drawings.

In the conventional aerosol-generating article, an aerosol is generated by heating an aerosol-generating substrate portion. However, due to variations in absorption of the ingredients contained in the aerosol-generating substrate portion, ingredients such as glycerin were not uniformly contained, and it was difficult to evenly transfer heat, so the amount of aerosol generation was not constant. In particular, there is a problem that a constant and abundant amount of atomization cannot be maintained until smoking is ended.

Accordingly, in the present invention, the present invention has been completed to provide an aerosol-generating article capable of generating a constant and abundant amount of aerosol from the start of smoking to the end of smoking.

As shown in FIGS. 1 to 4, the aerosol-generating article 100 of the present invention includes a nicotine-containing first aerosol-generating substrate portion 10, a second aerosol-generating substrate portion 30, and a filter portion 20 (22, 24, and 26 included), the second aerosol-generating substrate portion 30 is characterized in that it includes an absorber impregnated with a liquid aerosol-generating composition.

In one embodiment of the present invention, a weight ratio of glycerin contained in the nicotine-containing first aerosol-generating substrate portion 10 to glycerin contained in the second aerosol-generating substrate portion 30 may be 1 to 6:4 to 9, and more preferably 4 to 5:5 to 6.

In the present invention, glycerin is a material that generates an aerosol (atomization) and may be included in both the nicotine-containing first aerosol-generating substrate portion 10 and the second aerosol-generating substrate portion 30. However, since glycerin contained in the nicotine-containing first aerosol-generating substrate portion 10 is difficult to be evenly dispersed due to absorption deviation, and it is not easy to evenly transfer heat to glycerin contained in the nicotine-containing first aerosol-generating substrate portion 10, there is a limit to generating a consistent amount of atomization.

On the other hand, when glycerin is contained in the second aerosol-generating substrate portion 30, glycerin is contained as a main ingredient and may be uniformly impregnated in a certain form of absorber, thereby providing a consistently abundant amount of atomization.

However, when glycerin is contained only in the second aerosol-generating substrate portion 30, the aerosol-generating article 100 may have a disadvantage in that it is not harmoniously mixed with other aerosols such as nicotine.

Therefore, in the aerosol-generating article of the present invention, a weight ratio of glycerin contained in the nicotine-containing first aerosol-generating substrate portion 10 to glycerin contained in the second aerosol-generating substrate portion 30 is preferably 1 to 6:4 to 9.

In one embodiment of the present invention, glycerin may not be contained in the nicotine-containing first aerosol-generating substrate portion, and glycerin may be included only in the second aerosol-generating substrate portion 30. In this case, compared to the above case, it may have an advantage of generating atomization very consistently.

Figure 7:
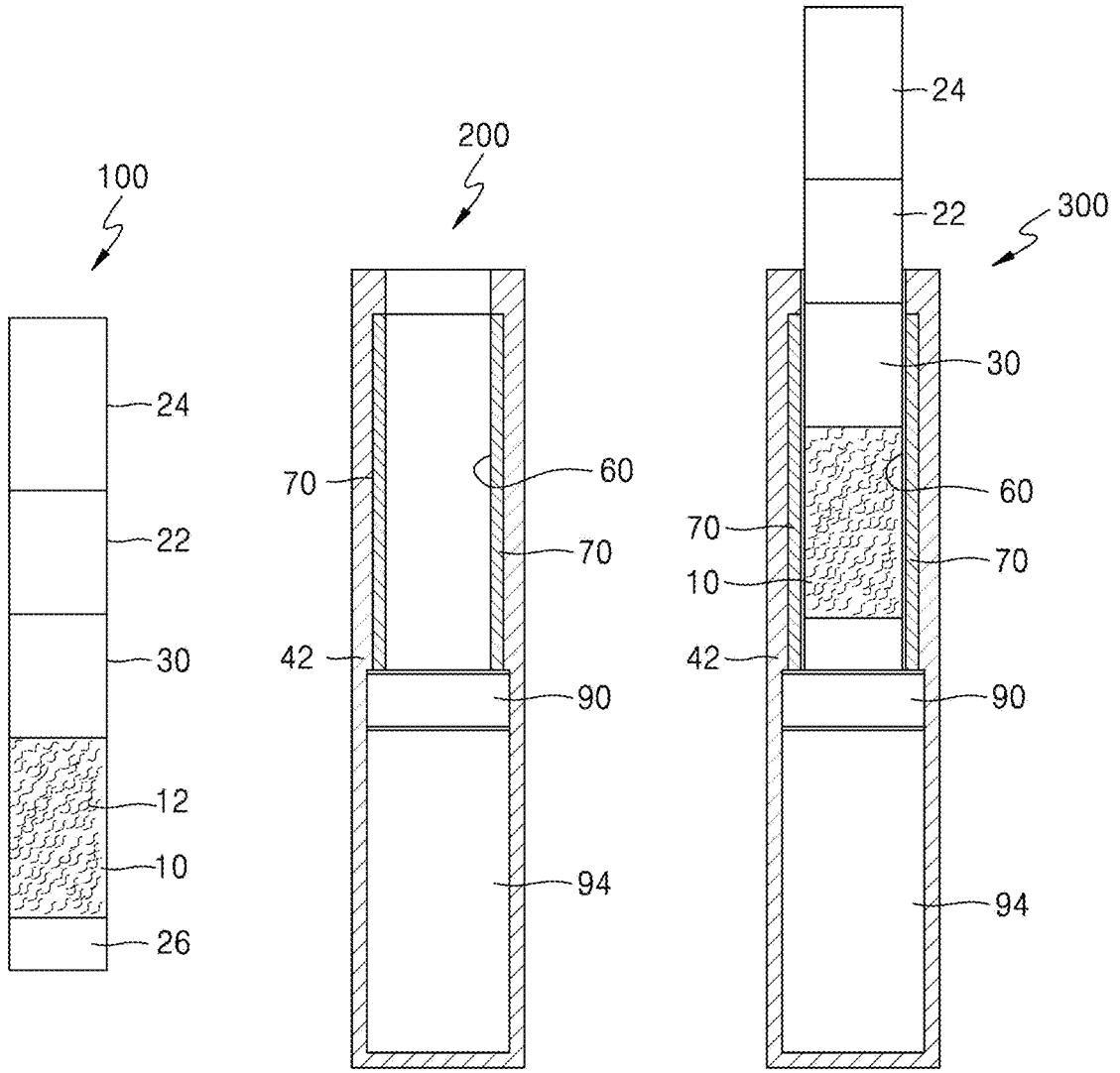
FIG. 7 is a diagram showing an embodiment of the aerosol-generating device, according to an embodiment.

As shown in FIG. 7, the aerosol-generating article of the present invention may generate a uniform and abundant aerosol until smoking is terminated by simultaneously heating the nicotine-containing first aerosol-generating substrate portion 10 and the second aerosol-generating substrate portion 30.

In one embodiment of the present invention, the nicotine-containing first aerosol-generating substrate portion 10 includes an aerosol-generating composition. The aerosol-generating composition may contain, for example, a tobacco material, an additive in an amount of 0.2 to 50 parts by weight 1, and glycerin in an amount of 0 to 400 parts by weight, based on 100 parts by weight of the tobacco material. However, it is not limited to these, and aerosol-generating compositions known in the art may be applied without limitation.

The tobacco material may be a solid material based on tobacco raw materials such as tobacco sheet (reconstituted tobacco sheet), cut tobacco, tobacco granules, reconstituted tobacco, but is not limited thereto, and tobacco materials known in the art may be used without limitation.

The reconstituted tobacco sheet may be categorized into a paper-type reconstituted tobacco sheet and a slurry-type reconstituted tobacco sheet. Among them, the slurry-type reconstituted tobacco sheet is produced by pulverizing tobacco leaves, mixing it with various substances such as a binder, pulp, and water to form a slurry, and then thinly spreading and drying the slurry.

The tobacco raw material may be tobacco leaf pieces, tobacco stems, tobacco dust generated during tobacco processing, and/or a strip of main leaf blade of tobacco leaves. In addition, the tobacco material may contain other additives such as wood cellulose fibers.

The additives may include at least one selected from the group consisting of propylene glycol, ethylene glycol, dipropylene glycol, diethylene glycol, triethylene glycol, tetraethylene glycol, and oleyl alcohol, flavoring agents, wetting agents, and cellulose acetate compounds.

The flavoring agent may include, for example, licorice, sucrose, fructose syrup, isosweet, cocoa, lavender, cinnamon, cardamom, celery, fenugreek, cascarilla, sandalwood, bergamot, geranium, honey essence, rose oil, vanilla, lemon oil, orange oil, mint oil, cinnamon, caraway, cognac, jasmine, chamomile, menthol, cinnamon, ylang-ylang, sage, spearmint, ginger, coriander or coffee.

In one embodiment of the present invention, the liquid aerosol-generating composition may contain glycerin in an amount of 5 to 60 parts by weight, propylene glycol (PG) in an amount of 0 to 15 parts by weight, additives in an amount of 5 to 40 parts by weight, and water in an amount of 0 to 10 parts by weight. However, it is not limited to these, and aerosol-generating compositions known in the art may be applied without limitation.

A weight ratio of glycerin to propylene glycol (PG) contained in the liquid aerosol-generating composition may be 9:1 to 7:3, more preferably 8.5:1.5 to 7.5:2.5. As such, it is possible to stably generate an abundant aerosol.

As the additive, an ingredient selected from additives and flavoring agents mentioned in the aerosol-generating composition may be used. In particular, when a liquid with a fragrance is added, it is preferable that a flavor may be added to the taste of the cigarette.

Glycerin impregnated in the absorber may be 5 to 60% by weight based on the total weight of the aerosol-generating composition.

In one embodiment of the present invention, the second aerosol-generating substrate portion 30 may be positioned in front of the nicotine-containing first aerosol-generating substrate portion 10, behind the nicotine-containing first aerosol-generating substrate portion 10, or both at front and back of the nicotine-containing first aerosol-generating substrate portion 10, as shown in FIGS. 1 to 4.

In one embodiment of the present invention, the absorber may be selected from the group consisting of paper, cotton, and silica, but is not limited thereto, and other materials known in the art may be used.

In one embodiment of the present invention, the absorber may be a rolled form of paper on which wrinkles are formed.

Figure 6A:
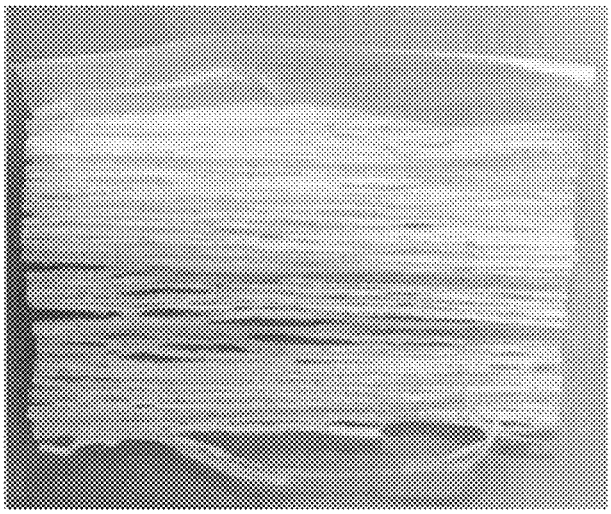
FIGS. 6A and 6B are photographs of an absorber included in a disposable liquid aerosol-generating article, according to an embodiment.

In addition, as shown in FIG. 6, the absorber may have a rolled form of paper with stripe-shaped wrinkles or sheaths which are inserted by crimping a paper base. The crimping is performed using a crimping device, and depending on the compressive strength, only wrinkles may be formed, or a sheath may be formed together with the wrinkles.

Figure 6B:
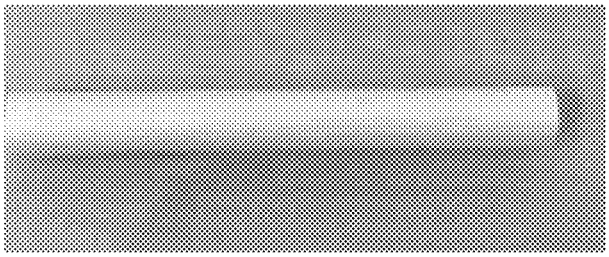

The final step in making the absorber may be performed with a paper base that does not contain wrinkles or sheaths, as shown in FIG. 6B.

The spacing of the stripe-shaped wrinkles or sheaths may be 0.1 to 10 mm, more preferably 1 to 2 mm.

Paper used as the absorber in the present invention may be made of mulberry, bamboo, birch paper, and it is preferable to use the birch paper.

The paper may have a thickness of 30 to 200 μm, more preferably 60 to 90 μm.

In the present invention, a method of manufacturing an absorber impregnated with a liquid substance will be described in detail as follows:

a. preparing absorbent paper made of birch (manufacturer name: Kookil Paper);

b. forming stripe-shaped wrinkles or sheaths on the absorbent paper;

c. spray-coating the absorbent paper with a liquid aerosol-generating composition;

d. rolling and cutting the absorbent paper produced in step c.

In one embodiment of the present invention, the liquid aerosol-generating composition may be impregnated with 0.05 to 0.8 g per 1 g of absorber. It is preferable to use the liquid aerosol-generating composition in the above range, because an aerosol-generating article may be manufactured in an appropriate size, and leakage of liquid substances may be prevented.

In one embodiment of the present invention, the disposable liquid aerosol-generating article may have a rate of 0 to 1% by weight at which the liquid aerosol-generating composition is transferred from the absorber to other components of the disposable liquid aerosol-generating article, when 24 hours have elapsed after completion of manufacture.

It is preferable that the rate at which the liquid aerosol-generating composition is transferred from the absorber to other components of the disposable liquid aerosol-generating article is closer to 0% by weight. When the rate exceeds 1% by weight, liquid substances may leak, and the quality of the disposable liquid aerosol-generating article may not be maintained because the wrapper is wet. In the above description, the lower limit value of the transfer rate may actually be a value greater than zero.

In the above description, the rate at which the liquid aerosol-generating composition is transferred from the absorber to other components of the disposable liquid aerosol-generating article means a percentage of the reduced weight of the absorber. The reduced weight of the absorber is a difference between the weight of the absorber measured immediately before assembling the absorber impregnated with the liquid aerosol-generating composition into an aerosol-generating article and the weight of the absorber measured again after taking the absorber out of the aerosol-generating article when 24 hours have elapsed after the aerosol-generating article is assembled.

In the aerosol-generating article of the present invention, in the case of manufacturing an aerosol-generating article by impregnating an absorber with a liquid aerosol-generating composition at a rate of 0.05 g to 0.8 g of the liquid aerosol-generating composition per 1 g of the absorbent, when 24 hours have elapsed after completion of manufacture, the rate of the liquid aerosol-generating composition transferred from the absorber to other components of the disposable liquid aerosol-generating article may satisfy 0 to 1% by weight, and more preferably 0.1 to 0.4% by weight.

In one embodiment of the present invention, the absorber impregnated with the liquid aerosol-generating composition may be rolled and directly included in a disposable liquid aerosol-generating article wrapper. This configuration is possible because the leakage of the liquid aerosol-generating composition in the absorber is controlled to a very small range as described above.

In addition, the absorber impregnated with the liquid aerosol-generating composition may be included in a rolled form in the aerosol-generating article using a non-waterproof cigarette paper, because the liquid does not leak to the outside.

Figure 5:
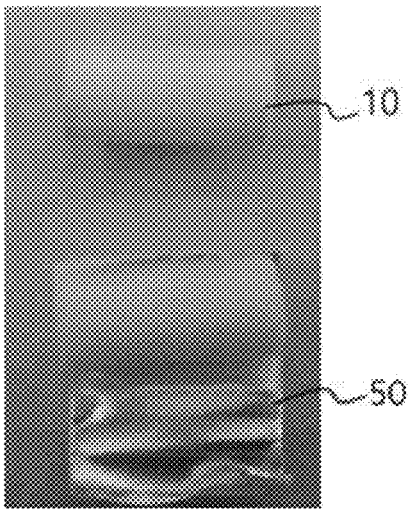
FIG. 5 is a photograph of an absorber impregnated with a liquid aerosol-generating composition included in the aerosol-generating article, according to an embodiment.

In detail, the absorber impregnated with the liquid aerosol-generating composition may be wrapped by a waterproof coat, and then wrapped again by general cigarette paper that is not waterproofed (see FIG. 5). However, in this case, there is a disadvantage in that the material cost and the number of processes increase.

The cigarette paper that is not waterproofed refers to the cigarette paper used in general dry type cigarettes.

However, in the present invention, in order to implement a more stable form, it is also possible to use a waterproofed cigarette paper. Even in this case, since the liquid aerosol-generating composition does not leak easily from the absorber, an aerosol-generating article may be sufficiently manufactured even with a light waterproofing.

The cigarette paper manufactured by the light waterproofing may include a cigarette paper in which a waterproof agent is added during manufacture of paper, a cigarette paper impregnated with a waterproof agent after manufacture of paper, and an aluminum coated cigarette paper.

In addition, in one embodiment of the present invention, separate waterproof paper may or may not be included between the absorber impregnated with the liquid aerosol-generating composition and the cigarette paper (see FIG. 5).

In one embodiment of the present invention, the length of the second aerosol-generating substrate portion 30 is shorter than that of the nicotine-containing first aerosol-generating substrate portion 10, and may be specifically 3 to 20 mm.

When the second aerosol-generating substrate portion 30 is formed beyond the above-described range, the size of the heater must also be increased during heating, so it is preferable to manufacture the second aerosol-generating substrate portion 30 in the above-described range.

Figure 4:
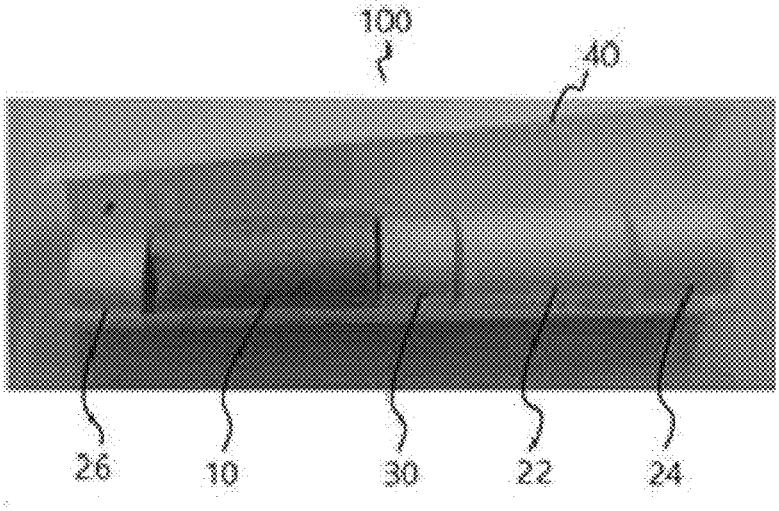
FIG. 4 is a photograph of an aerosol-generating article according to an embodiment.

In the aerosol-generating article of the present invention, the filter portion 20 may include filters arranged at various positions and having various functions. In detail, the aerosol-generating article of the present invention may include a cooling filter 22, a mouthpiece filter 24, a front end filter 26, and a tube filter (not shown), as shown in FIG. 4.

For example, when the second aerosol-generating substrate portion 30 is located behind the nicotine-containing first aerosol-generating substrate portion 10, the cooling filter 22 may be positioned behind the second aerosol-generating substrate portion 30, and when the second aerosol-generating substrate portion 30 is located in front of the nicotine-containing first aerosol-generating substrate portion 10, the cooling filter 22 is located behind the nicotine-containing first aerosol-generating substrate portion 10.

The cooling filter 22 cools an aerosol generated when the nicotine-containing first aerosol-generating substrate portion 10 is heated by an external heating source. Therefore, the user may inhale the aerosol cooled to an appropriate temperature.

The mouthpiece filter 24 is located behind the cooling filter 22 described above, and may be a cellulose acetate filter. For example, the mouthpiece filter 26 may be manufactured as a recess filter including a hollow, but is not limited thereto.

In addition, in an embodiment of the present invention, the second aerosol-generating substrate portion 30 described above may also serve as a tube filter (not shown). In addition, the filter portion 20 may further include a tube filter in front of the cooling filter 22.

In one embodiment of the present invention, in addition to the filter portion 20 described above, a front end filter 26 may be further provided. In a case where the second aerosol-generating substrate portion 30 is located behind the nicotine-containing first aerosol-generating substrate portion 10, the front end filter 26 is positioned in front of the nicotine-containing first aerosol-generating substrate portion 10. On the other hand, when the second aerosol-generating substrate portion 30 is located in front of the nicotine-containing first aerosol-generating substrate portion 10, the front end filter 26 is in front of the second aerosol-generating substrate portion 30. The configuration of the tip filter 26 may be omitted if necessary.

The front end filter 26 may perform a function of allowing the nicotine-containing first aerosol-generating substrate portion 10 or the second aerosol-generating substrate portion 30 to be structurally stable. As the front end filter 26, a filter known in the art may be used without limitation.

In one embodiment of the present invention, the aerosol-generating article 100 may be packaged by a cigarette paper 40. The cigarette paper 40 may be used without limitation as long as it is known in the art.

In addition, the present invention relates to an aerosol-generating device 300, as shown in FIG. 7, wherein the aerosol-generating device 300 includes an aerosol-generating article 100 of the present invention; and an aerosol-generating article receiving groove 60 and a heater member 70 provided at the bottom of the aerosol-generating article receiving groove.

In one embodiment of the present invention, the heater member 70 has a feature that is provided so as to simultaneously heat the nicotine-containing first aerosol-generating substrate portion 10 and the second aerosol-generating substrate portion 30.

As the heater member 70, a cylindrical heater may be preferably used.

In the aerosol-generating device 300 of the present invention, a technical configuration known in the art may be applied as it is, except for the technical features specifically limited above. For example, the aerosol generator 200 may further include configurations such as a control circuit 90 and a rechargeable battery 94 as shown in FIG. 7.

MODE OF DISCLOSURE

Hereinafter, examples are presented to aid the understanding of the present invention, butt the following examples are only illustrative of the present invention, and it is obvious to those skilled in the art that various changes and modifications are possible within the scope and technical idea of the present invention. And it is natural that such changes and modifications belong to the appended claims.

Examples 1 to 3: Manufacturing of Aerosol-Generating Article and Measurement of Amount of Leakage The aerosol-generating article of the present invention was manufactured in the form as shown in FIG. 4.

In the aerosol-generating article, the absorber was manufactured by forming a sheath as in FIG. 6 with a crimp on paper made of birch (manufacturer name: Kookil Paper), spraying the paper with a liquid aerosol-generating composition, and rolling the paper.

The liquid aerosol-generating composition contains glycerin (ELOGLYN R995, manufactured by LG Household & Health Care), which is commercially available.

Three cigarettes were manufactured using a non-waterproof paper (brand name: MFW, manufactured by Kookil Paper) as a cigarette paper.

In the above, immediately before assembling the cigarette, the weight of the absorber impregnated with the liquid aerosol-generating composition was measured, and then the cigarette was assembled. And after the cigarette was assembled, after 24 hours had elapsed, the absorber was taken out from the aerosol-generating article and the weight was measured again, and the reduced weight compared to the initial measurement was calculated and shown in Table 1 below.

TABLE 1

| | Weight of absorber impregnated with liquid aerosol-generating composition before assembly of aerosol-generating article (g) (weight of impregnated liquid substance (g)) | Weight of assembled cigarette (g) | Weight of absorber impregnated with liquid aerosol-generating composition after 24 hours from completion of assembly of aerosol-generating article (g) | Change in weight of absorber impregnated with liquid aerosol-generating composition (w/w %) |
|---|---|---|---|---|
| Example 1 | 0.1091 (0.0378) | 0.411 | 0.1088 | 0.27% |
| Example 2 | 0.1125 (0.0401) | 0.4075 | 0.1121 | 0.36% |
| Example 3 | 0.1131 (0.0429) | 0.4064 | 0.1127 | 0.36% |

As shown in Table 1, in the aerosol-generating article of the present invention, it was confirmed that almost no leakage of liquid substances occurs from absorber impregnated with liquid aerosol-generating composition into other portions of the cigarette.

Although the present invention has been described in connection with the above-mentioned preferred embodiments, it is possible to make various modifications or variations without departing from the gist and scope of the invention. Accordingly, appended claims cover such modifications or variations as long as they fall within a gist of the present invention.

EXPLANATION OF REFERENCE NUMERALS

10: nicotine-containing first aerosol-generating substrate portion 20: filter portion
22: cooling filter 24: mouthpiece filter
26: front end filter 30: second aerosol-generating substrate portion
40: cigarette paper 50: waterproof paper
60: aerosol-generating article receiving groove 70: heater
90: control circuit 94: rechargeable battery
100: aerosol-generating article 200: aerosol generator
300: aerosol-generating device

What is claimed is:

1. An aerosol-generating article comprising:

a nicotine-containing first aerosol-generating substrate portion;

a second aerosol-generating substrate portion; and a filter portion, wherein the second aerosol-generating substrate portion includes an absorber impregnated with a liquid aerosol-generating composition, and wherein a weight ratio of glycerin contained in the nicotine-containing first aerosol-generating substrate portion to glycerin contained in the second aerosol-generating substrate portion is 1 to 6:4 to 9.

2. The aerosol-generating article of claim 1, wherein the nicotine-containing first aerosol-generating substrate portion contains an aerosol-generating composition, and the aerosol-generating composition contains a tobacco material, an additive in an amount of 0.2 to 50 parts by weight based on 100 parts by weight of the tobacco material, and glycerin in an amount of 0 to 400 parts by weight based on 100 parts by weight of the tobacco material.

3. The aerosol-generating article of claim 1, wherein the liquid aerosol-generating composition contains glycerin in an amount of 5 to 60 parts by weight, propylene glycol (PG) in an amount of 0 to 15 parts by weight, an additive in an amount of 5 to 40 parts by weight, and water in an amount of 0 to 10 parts by weight.

4. The aerosol-generating article of claim 1, wherein the second aerosol-generating substrate portion is positioned in front of the nicotine-containing first aerosol-generating substrate portion, behind the nicotine-containing first aerosol-generating substrate portion, or at front and back of the nicotine-containing first aerosol-generating substrate portion.

5. The aerosol-generating article of claim 1, wherein the absorber impregnated with the liquid aerosol-generating composition is selected from the group consisting of paper, cotton, and silica.

6. The aerosol-generating article of claim 5, wherein the absorber impregnated with the liquid aerosol-generating composition is a rolled form of paper in which stripe-shaped wrinkles or sheaths are formed by crimping the paper.

7. An aerosol-generating device comprising:

the aerosol-generating article of claim 1, and an aerosol generator including an aerosol-generating article receiving groove and a heater member provided under the aerosol-generating article receiving groove.

8. The aerosol-generating device of claim 7, wherein the heater member is configured to simultaneously heat the nicotine-containing first aerosol-generating substrate portion and the second aerosol-generating substrate portion.

* * * * *